US011434713B2

(12) United States Patent
Eitschberger et al.

(10) Patent No.: US 11,434,713 B2
(45) Date of Patent: Sep. 6, 2022

(54) WELLHEAD LAUNCHER SYSTEM AND METHOD

(71) Applicant: DynaEnergetics Europe GmbH, Troisdorf (DE)

(72) Inventors: Christian Eitschberger, Munich (DE); Liam McNelis, Bonn (DE); Thilo Scharf, Letterkenny (IE); Andreas Robert Zemla, Much (DE); Shmuel Silverman, Novato, CA (US)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/919,473

(22) Filed: Jul. 2, 2020

(65) Prior Publication Data

US 2020/0332618 A1 Oct. 22, 2020

Related U.S. Application Data

(63) Continuation-in-part of application No. 16/788,107, filed on Feb. 11, 2020, now Pat. No. 10,844,684, (Continued)

(51) Int. Cl.
*E21B 33/068* (2006.01)
*E21B 23/08* (2006.01)

(52) U.S. Cl.
CPC ..... *E21B 33/068* (2013.01); *E21B 23/08* (2013.01)

(58) Field of Classification Search
CPC ..... E21B 23/08; E21B 23/10; E21B 33/068; E21B 43/1185
See application file for complete search history.

(56) References Cited

U.S. PATENT DOCUMENTS 2,550,004 A 4/1951 Doll
2,713,909 A * 7/1955 Baker ..... E21B 33/05 15/104.062

(Continued)

FOREIGN PATENT DOCUMENTS

CA 2833722 A1 * 5/2014 ..... E21B 15/00
CA 2833722 A1 5/2014

(Continued)

OTHER PUBLICATIONS

Entchev et al., Autonomous Perforating System for Multizone Completions, SPE International, 2011, 7 pgs., https://www.onepetro.org/conference-paper/SPE-147296-MS.

(Continued)

*Primary Examiner* — Jennifer H Gay
(74) *Attorney, Agent, or Firm* — Moyles IP, LLC

(57) ABSTRACT

A drone conveyance system and a wellhead receiver for deploying drones into an oil or gas wellbore includes a platform, a drone magazine, a platform receiver, a conveyance, and a wellhead receiver. The wellhead receiver prepares the drone to be inserted into the wellbore via the wellhead. Preparation of the drone to be inserted into the wellbore includes adjusting the physical conditions surrounding the drone to approximate the physical conditions in the wellbore. The preparation may be performed using fluid inputs and outputs connected to a compartment of the wellhead receiver. Other preparation processes may also take place in the wellhead receiver such as assuring the appropriate drone is being inserted, that the drone has been programmed appropriately, that safety devices have been deactivated and charging an onboard power supply of the drone.

20 Claims, 10 Drawing Sheets

Related U.S. Application Data which is a continuation of application No. 16/423,230, filed on May 28, 2019, now Pat. No. 10,605,037.

(60) Provisional application No. 62/870,865, filed on Jul. 5, 2019, provisional application No. 62/841,382, filed on May 1, 2019, provisional application No. 62/678,654, filed on May 31, 2018.

(56) References Cited

U.S. PATENT DOCUMENTS 2,755,863 A 7/1956 Stansbury et al.
3,220,480 A 11/1965 Myers
3,244,232 A 4/1966 Myers
3,298,437 A 1/1967 Conrad
3,303,884 A 2/1967 Medford
3,493,061 A * 2/1970 Gyongyosi ..... E21B 19/146 175/85
3,710,867 A * 1/1973 Bansbach ..... E21B 41/02 166/244.1
4,234,768 A 11/1980 Boop
5,115,196 A 5/1992 Low et al.
6,044,905 A * 4/2000 Harrison, III ..... E21B 41/02 166/70
6,056,058 A 5/2000 Gonzalez
6,182,765 B1 * 2/2001 Kilgore ..... E21B 23/14 166/381
6,269,875 B1 8/2001 Harrison, III et al.
6,272,782 B1 8/2001 Dittrich et al.
6,333,699 B1 12/2001 Zierolf
6,454,011 B1 * 9/2002 Schempf ..... E21B 19/143 166/70
6,457,526 B1 * 10/2002 Dailey ..... E21B 19/002 166/356
6,474,931 B1 11/2002 Austin et al.
6,488,093 B2 * 12/2002 Moss ..... E21B 19/22 166/365
6,659,180 B2 12/2003 Moss
6,719,061 B2 4/2004 Muller et al.
6,808,021 B2 * 10/2004 Zimmerman ..... E21B 33/076 166/341
6,966,262 B2 11/2005 Jennings, III
6,988,449 B2 1/2006 Teowee et al.
7,018,164 B2 3/2006 Anthis et al.
7,036,598 B2 * 5/2006 Skjærseth ..... E21B 7/124 166/365
7,082,877 B2 8/2006 Jennings, III
7,140,453 B2 * 11/2006 Ayling ..... E21B 19/20 175/85
7,168,494 B2 1/2007 Starr et al.
7,204,308 B2 4/2007 Dudley et al.
7,234,525 B2 * 6/2007 Alves ..... E21B 33/068 166/310
7,240,742 B2 7/2007 Sewell et al.
7,322,416 B2 1/2008 Burris, II et al.
7,331,394 B2 2/2008 Edwards et al.
7,347,145 B2 3/2008 Teowee et al.
7,353,879 B2 4/2008 Todd et al.
7,464,647 B2 12/2008 Teowee et al.
7,588,080 B2 9/2009 McCoy
7,617,775 B2 11/2009 Teowee
7,631,704 B2 * 12/2009 Hagemeyer ..... E21B 19/146 166/380
7,681,500 B2 3/2010 Teowee
8,006,765 B2 * 8/2011 Richards ..... E21B 7/124 166/341
8,074,713 B2 12/2011 Ramos et al.
8,136,585 B2 * 3/2012 Cherewyk ..... E21B 33/068 15/104.062
8,141,639 B2 3/2012 Gartz et al.
8,151,882 B2 4/2012 Grigar et al.
8,317,448 B2 * 11/2012 Hankins ..... E21B 19/14 414/22.68
8,505,632 B2 8/2013 Guerrero et al.
8,646,520 B2 2/2014 Chen
8,810,247 B2 8/2014 Kuckes
8,899,322 B2 12/2014 Cresswell et al.
8,950,480 B1 2/2015 Strickland
8,981,957 B2 3/2015 Gano et al.
9,328,577 B2 5/2016 Hallundbaek et al.
9,359,884 B2 6/2016 Hallundbaek et al.
9,441,470 B2 9/2016 Guerrero et al.
9,617,814 B2 4/2017 Seals et al.
9,617,829 B2 4/2017 Dale et al.
9,726,005 B2 8/2017 Hallundbaek et al.
9,797,238 B2 10/2017 Frosell et al.
9,903,192 B2 * 2/2018 Entchev ..... E21B 44/005
9,951,563 B2 * 4/2018 Beaton ..... E21B 10/42
9,963,955 B2 5/2018 Tolman et al.
10,001,007 B2 6/2018 Pelletier et al.
10,053,968 B2 8/2018 Tolman et al.
10,100,612 B2 * 10/2018 Lisowski ..... E21B 34/14
10,246,952 B2 * 4/2019 Trydal ..... G06V 10/10
10,301,910 B2 5/2019 Whitsitt et al.
10,323,484 B2 * 6/2019 Liess ..... E21B 19/16
10,358,880 B2 * 7/2019 Metcalf ..... E21B 7/02
10,584,552 B2 * 3/2020 Cannon ..... E21B 33/068
10,598,002 B2 3/2020 Sites
10,605,037 B2 * 3/2020 Eitschberger ..... E21B 33/068
10,844,684 B2 * 11/2020 Eitschberger ..... E21B 23/08
10,927,650 B2 * 2/2021 Schultz ..... E21B 43/26
11,047,189 B2 * 6/2021 Fernandes ..... E21B 23/08
11,136,866 B2 10/2021 Holodnak et al.
11,149,515 B1 * 10/2021 Bull ..... E21B 33/068
2002/0036101 A1 * 3/2002 Huhdanmaki ..... E21B 19/14 175/85
2002/0040783 A1 * 4/2002 Zimmerman ..... E21B 33/076 166/360
2002/0129941 A1 * 9/2002 Alves ..... E21B 37/06 166/70
2002/0134552 A1 * 9/2002 Moss ..... E21B 33/076 166/70
2004/0094305 A1 * 5/2004 Skjærseth ..... E21B 7/124 166/70
2004/0239521 A1 12/2004 Zierolf
2005/0011645 A1 1/2005 Aronstam et al.
2005/0103526 A1 * 5/2005 Ayling ..... E21B 19/155 175/85
2005/0217844 A1 * 10/2005 Edwards ..... E21B 7/124 166/85.1
2006/0054326 A1 * 3/2006 Alves ..... E21B 33/068 166/310
2008/0223587 A1 * 9/2008 Cherewyk ..... E21B 33/068 166/69
2009/0211760 A1 * 8/2009 Richards ..... E21B 7/124 166/85.1
2009/0255728 A1 * 10/2009 Spencer ..... E21B 7/124 175/5
2009/0308589 A1 12/2009 Bruins et al.
2010/0288496 A1 * 11/2010 Cherewyk ..... E21B 43/14 166/284
2011/0005777 A1 1/2011 Meff
2012/0234780 A1 9/2012 Hokanson
2013/0062055 A1 * 3/2013 Tolman ..... E21B 43/119 175/4.51
2013/0228326 A1 9/2013 Griffith et al.
2014/0008071 A1 1/2014 Paiierson et al.
2014/0083774 A1 * 3/2014 Hoult ..... E21B 17/00 175/52
2014/0131035 A1 * 5/2014 Entchev ..... E21B 43/119 166/53
2014/0218207 A1 8/2014 Gano et al.
2014/0360720 A1 12/2014 Corbeil
2015/0114626 A1 4/2015 Hatten et al.
2015/0167410 A1 * 6/2015 Garber ..... F16F 15/06 248/560
2015/0209954 A1 * 7/2015 Hokanson ..... B25H 3/04 175/57
2016/0084075 A1 3/2016 Ingraham et al.
2016/0108722 A1 4/2016 Whitsitt et al.
2016/0115741 A1 * 4/2016 Davis ..... E21B 15/003 414/800

(56) References Cited

U.S. PATENT DOCUMENTS

| | | | | |
|---|---|---|---|---|
| 2016/0215592 | A1* | 7/2016 | Helms | E21B 19/16 |
| 2017/0044875 | A1* | 2/2017 | Hebebrand | E21B 41/0092 |
| 2017/0067303 | A1* | 3/2017 | Thiemann | E21B 33/14 |
| 2017/0067320 | A1* | 3/2017 | Zouhair | E21B 19/20 |
| 2017/0159379 | A1* | 6/2017 | Metcalf | E21B 7/26 |
| 2017/0175488 | A1* | 6/2017 | Lisowski | E21B 23/08 |
| 2017/0204687 | A1* | 7/2017 | Yorga | E21B 19/08 |
| 2017/0306710 | A1* | 10/2017 | Trydal | G06V 10/10 |
| 2017/0314372 | A1* | 11/2017 | Tolman | E21B 33/134 |
| 2017/0370169 | A1* | 12/2017 | Genovese | E21B 33/068 |
| 2018/0002999 | A1 | 1/2018 | Johnson | |
| 2018/0003038 | A1 | 1/2018 | Cherewyk | |
| 2018/0148995 | A1 | 5/2018 | Burky et al. | |
| 2018/0156029 | A1 | 6/2018 | Harrison et al. | |
| 2018/0283836 | A1 | 10/2018 | Thomas | |
| 2018/0313182 | A1* | 11/2018 | Cherewyk | E21B 33/068 |
| 2018/0355674 | A1* | 12/2018 | Cooper | E21B 7/124 |
| 2019/0031307 | A1* | 1/2019 | Siersdorfer | B63G 8/001 |
| 2019/0186211 | A1* | 6/2019 | Gonzalez Gonzalez | E21B 15/003 |
| 2019/0218880 | A1* | 7/2019 | Cannon | E21B 33/068 |
| 2019/0316449 | A1* | 10/2019 | Schultz | E21B 43/116 |
| 2019/0330933 | A1 | 10/2019 | Mikalsen | |
| 2019/0330935 | A1 | 10/2019 | Mikalsen et al. | |
| 2019/0330936 | A1 | 10/2019 | Mikalsen et al. | |
| 2019/0330937 | A1 | 10/2019 | Mikalsen | |
| 2019/0338606 | A1* | 11/2019 | Metcalf | E21B 7/02 |
| 2019/0368301 | A1* | 12/2019 | Eitschberger | E21B 23/08 |
| 2019/0368321 | A1 | 12/2019 | Eitschberger et al. | |
| 2019/0368331 | A1 | 12/2019 | Vick, Jr. et al. | |
| 2020/0018139 | A1 | 1/2020 | Eitschberger et al. | |
| 2020/0056442 | A1* | 2/2020 | Cherewyk | E21B 33/068 |
| 2020/0063553 | A1 | 2/2020 | Zemla et al. | |
| 2020/0157909 | A1* | 5/2020 | Fernandes | E21B 31/18 |
| 2020/0190932 | A1* | 6/2020 | Eitschberger | E21B 23/08 |
| 2020/0308924 | A1* | 10/2020 | Pitcher | E21B 33/072 |
| 2020/0332618 | A1* | 10/2020 | Eitschberger | E21B 33/068 |

FOREIGN PATENT DOCUMENTS

| | | | | | |
|---|---|---|---|---|---|
| CN | 201546707 | U | | 8/2010 | |
| CN | 204430910 | U | | 7/2015 | |
| DE | 10341437 | A1 | | 4/2005 | |
| DE | 10344523 | A1 | | 4/2005 | |
| DE | 602004006439 | | | 1/2008 | |
| EP | 1688584 | B1 | | 8/2011 | |
| EP | 2310616 | B1 | | 10/2017 | |
| GB | 839486 | A | | 6/1960 | |
| GB | 2457081 | A | * | 8/2009 | E21B 23/08 |
| WO | 0133029 | A2 | | 5/2001 | |
| WO | 2011051435 | A2 | | 5/2011 | |
| WO | 2011146866 | A2 | | 11/2011 | |
| WO | 2011150251 | A1 | | 12/2011 | |
| WO | 2012161854 | A2 | | 11/2012 | |
| WO | 2015081092 | A3 | | 8/2015 | |
| WO | 2018094220 | A1 | | 5/2018 | |
| WO | 2018182565 | A1 | | 10/2018 | |
| WO | WO-2019033183 | A1 | * | 2/2019 | E21B 23/08 |
| WO | 2019229520 | A1 | | 12/2019 | |
| WO | 2019229521 | A1 | | 12/2019 | |
| WO | 2020002383 | A1 | | 1/2020 | |
| WO | 2020002983 | A1 | | 1/2020 | |
| WO | 2020035616 | A1 | | 2/2020 | |
| WO | WO-2020254099 | A1 | * | 12/2020 | E21B 23/10 |

OTHER PUBLICATIONS

International Searching Authority; International Preliminary Report on Patentability for PCT/EP2019/066919; dated Jan. 7, 2021; 9 pages.

International Searching Authority; International Preliminary Report on Patentability for PCT/IB2019/000530; dated Jan. 7, 2021; 9 pages.

International Searching Authority; Invitation to Pay Additional Fees with Partial International Search for Application No. PCT/EP2020/075788; dated Jan. 19, 2021; 9 pages.

United States Patent and Trademark Office; Non-Final Office Action for U.S. Appl. No. 16/537,720; dated Jun. 15, 2021; 13 pages.

International Searchiing Authority, International Search Report and Written Opinion of International App. No. PCT/EP2019/063966, dated Aug. 30, 2019, 10 pgs.

United States Patent and Trademark Office, Office Action of U.S. Appl. No. 16/423,230, dated Aug. 27, 2019, 16 pgs.

United States Patent and Trademark Office, Office Action of U.S. Appl. No. 16/423,230, dated Nov. 4, 2019, 14 pgs.

International Searching Authority; International Preliminary Report on Patentability of the International Searching Authority for PCT/EP2020/065180; dated Dec. 21, 2021; 7 pages.

International Searching Authority; International Search Report and Written Opinion for PCT Appl PCT/EP2020/065180; dated Oct. 6, 2020; 11 pages.

United States Patent and Trademark Office; Advisory Action Before the Filing of an Appeal Brief for U.S. Appl. No. 16/537,720; dated Dec. 27, 2021; 3 pages.

United States Patent and Trademark Office; Non-Final Office Action for U.S. Appl. No. 17/254,198; dated Dec. 22, 2021; 17 pages.

Entchev et al., "Autonomous Perforating System for Multizone Completions," SPE 147296, Prepared for Presentation at Society of Petroleum Engineers (SPE) Annual Technical Conference and Exhibition held Oct. 30, 2011-Nov. 2, 2011, 7 pgs.

International Searching Authority, International Search Report and Written Opinion for PCT App. No. PCT/IB2019/000526; dated Sep. 25, 2019, 17 pgs.

International Searching Authority, International Search Report and Written Opinion for PCT App. No. PCT/IB2019/000530; dated Oct. 8, 2019; 13 pgs.

International Searching Authority, The International Search Report and Written Opinion of International App. No. PCT/IB2019/000537, dated Sep. 25, 2019, 18 pgs.

International Searching Authority; International Preliminary Report on Patentability for International Application No. PCT/IB2019/000537; dated Dec. 10, 2020; 11 pages.

International Searching Authority; International Preliminary Report on Patentability for International Application No. PCT/IB2019/000526; dated Dec. 10, 2020; 10 pages.

International Searching Authority; International Search Report and Written Opinion for PCT App. No. PCT/EP2019/066919; dated Sep. 10, 2019; 11 pages.

International Searching Authority; International Search Report and Written Opinion for PCT App. No. PCT/EP2019/072032; dated Nov. 15, 2019; 13 pages.

International Searching Authority; International Search Report and Written Opinion for PCT App. No. PCT/EP2019/072064; dated Nov. 20, 2019; 15 pages.

International Searching Authority; International Search Report and Written Opinion of the International Searching Authority for PCT/EP2020/070291; dated Dec. 15, 2020; 14 pages.

United States Patent and Trademark Office, Non-final Office Action of U.S. Appl. No. 16/451,440, dated Det. 24, 2019, 22 pgs.

United States Patent and Trademark Office; Final Office Action for U.S. Appl. No. 16/451,440; dated Feb. 7, 2020; 11 pages.

United States Patent and Trademark Office; Non-Final Office Action for U.S. Appl. No. 16/542,890; dated Nov. 4, 2019; 16 pages.

United States Patent and Trademark Office; Non-Final Office Action for U.S. Appl. No. 16/542,890; dated Sep. 30, 2020; 17 pages.

United States Patent and Trademark Office; Notice of Allowance for U.S. Appl. No. 16/451,440; dated Jun. 5, 2020; 8 pages.

United States Patent and Trademark Office; Final Office Action for U.S. Appl. No. 17/254,198; dated May 26, 2022; 19 pages.

United States Patent and Trademark Office; Non-Final Office Action for U.S. Appl. No. 17/072,067; dated Mar. 31, 2022; 15 pages.

* cited by examiner

WELLHEAD LAUNCHER SYSTEM AND METHOD

CROSS-REFERENCE TO RELATED APPLICATIONS

This application is a Continuation-in-Part patent application of Ser. No. 16/788,107 filed Feb. 11, 2020, which is a continuation of U.S. application Ser. No. 16/423,230 filed May 28, 2019, which claims the benefit of U.S. Provisional Patent Application No. 62/841,382, filed May 1, 2019 and U.S. Provisional Patent Application No. 62/678,654, filed May 31, 2018, each of which is incorporated herein by reference in its entirety. This application also claims the benefit of U.S. Provisional Application No. 62/870,865 filed Jul. 5, 2019, which is incorporated herein by reference in its entirety.

FIELD OF THE INVENTION

The present invention relates to a method and apparatus for handling and inserting tools, including tools in the form of untethered drones, into a pressurized wellbore.

BACKGROUND OF THE DISCLOSURE

Oil and gas reserves are accessed using various drilling and completion techniques. The drilling techniques require preparation of a drilling site by the formation of a wellbore 50, as illustrated in FIG. 1. A wellbore 50 is a narrow shaft drilled in the ground, vertically and/or horizontally as well as angles therebetween. A wellbore 50 can include a substantially vertical portion and a substantially horizontal portion. The vertical portion of a typical wellbore 50 may be over a mile in depth, while the horizontal portion may be several miles in length due to longer laterals and advancements in horizontal drilling.

A tool 31 or tool string 31' is typically introduced into a wellbore 50 by attaching a lubricator 23 to a blowout preventer 25 at the wellhead 30 of a well casing. The lubricator 23 is a series of large diameter tubular members assembled on top of wellhead 30 and may include a grease injection tube and/or stuffing box 27 through which a wireline 24 for suspending the tool 31 is passed. The lubricator 23 is typically long, heavy and difficult to manipulate in the rig 26. It may also be difficult to make the required connections to a lubricator 23. After the lubricator 23 and stuffing box 27 have been assembled, the lubricator 23 is hoisted into position on the blowout preventer 25 and secured thereto. Pressure between the wellbore 50 and lubricator 23 is equalized by valves around the blowout preventer 25. The blowout preventer 25 is then opened allowing access to the borehole. After the blowout preventer 25 has been opened, the tool 31 can be lowered into the wellbore 50 by a wireline 24 with the grease injection tube or stuffing box 27 providing a seal around the wireline 24 as the tool 31 is lowered.

Once the tool has served its desired purpose in the wellbore 50, the tool 31 is extracted from the wellbore 50 by drawing it up to a position within the lubricator 23, closing the blowout preventer 25, venting the lubricator 23, and removing the tool 31. When no more tools will be deployed in the wellbore, the lubricator 23 may be removed from the blowout preventer 25 and lowered to a position where it can be subsequently disassembled into its individual components. It will be appreciated from the foregoing description that there are a number of difficulties in such an operation, including knowing when the tool 31 has been fully withdrawn into the lubricator 23, not pulling the wireline 24 so taut against the stuffing box 27 that there is a possibility of the wireline 24 being broken with the result being the tool 31 falling downhole before the blowout preventer 25 can be closed, and closing the blowout preventer 25 on the tool 31 before it is fully withdrawn into the lubricator 23. Of course, handling the tool 31 during the extraction process is equally as difficult as handling it during the insertion process.

A wireline, electric line, or e-line 24 is cabling technology used to lower and retrieve tools 31 into and out of the wellbore 50 for the purpose of delivering an explosive charge, evaluation of the wellbore 50, or other completion-related or closure-related tasks. The equipment/devices disposed in the wellbore 50 are often generically referred to as downhole tools and examples of such tools 31 are perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools, and ballistic tools. Such downhole tools 31 are typically attached to the wireline 24, fed through or run inside the casing or tubing, and are lowered into the wellbore 50. Other methods include tubing conveyed (i.e., TCP for perforating) or coil tubing conveyance. The speed of unwinding the wireline cable 24 and winding the wireline cable 24 back up is limited based on a speed of the wireline equipment rig 26 and forces on the wireline cable 24 itself (e.g., friction within the well). Because of these limitations, it typically takes several hours for the wireline cable 24 and the attached tool 31 or tool-string 31' to be lowered into the wellbore 50 and another several hours for the wireline cable 24 to be wound back up and the toolstring 31' retrieved. When detonating explosives, the wireline cable 24 will be used to position a downhole tool 31 or toolstring 31' into the wellbore 50.

This type of deployment process requires the selection of a downhole tool 31, the attachment of that tool 31 or a combination of tools in a toolstring 31' to the wireline 24, and in some instances, the removal of the downhole tool(s) 31 from the wellbore 50. When an operator needs to deploy additional downhole tools 31 into the wellbore 50, which may be the same as or different from previously-deployed tool(s), the operator must first retract/retrieve the wireline 24 from the wellbore 50 and then attach the wireline 24 to the additional downhole tool(s) 20. That is, no practical means exists for disposing more than one wireline 24 into a wellbore 50 during typical operations. This completion process requires multiple steps, a significant array of equipment, and can be time consuming and costly. Furthermore, equipment lodged in the wellbore will typically result in complication, delay, additional human resource time, equipment cost and, often, exorbitant expense to operations.

The various drilling and completion operations requiring deployment of various downhole tools 31, as well as the changing between different types of tools being deployed, currently require direct human interaction with the wireline 24, the tools 31 on the wireline 24, and the feeding of tools/wireline into the equipment attached to the wellhead 30. Wellhead 30 is a general term used to describe the pressure-containing component at the surface of an oil well that provides the interface for drilling, completion, and testing of all subsurface operation phases. Being pressurized and the pressurization subject to an unknown level of variability, in addition to the substantial amount of shifting equipment adjacent the wellhead 30, the area around the wellhead 30 is referred to as a 'red zone'. That is, the dangers inherent in drilling and completion operations are focused in the area within a few yards or tens of yards around the wellhead 30. During operations, only trained personnel are permitted within a certain distance of the wellhead 30 and those personnel must be properly protected. Even then, the activities of attaching and detaching tools 31 from a wireline 24, disposing a wireline 24 and attached toolstring 31' into the wellbore 50 and retrieving a wireline 24 and the attached toolstring 31' from the wellbore 50, are inherently difficult, dirty and dangerous.

In view of the disadvantages associated with currently available devices and methods for well completion, there is a need for a device and method that increases the efficiency of the completion processes. There is a further need for a device and method that reduces the steps, time to achieve steps, time between steps and associated costs and equipment for well completion processes. There is a further need for a system and method that reduces the delay between drilling of a wellbore and production of oil or gas from the wellbore. In light of the dangers of disposing and retrieving tools from a wellbore, there is also a need to reduce or eliminate the number of persons in the red zone adjacent the wellhead, especially during particularly risk prone activities.

BRIEF DESCRIPTION OF THE EXEMPLARY EMBODIMENTS

This disclosure generally describes deployment systems for devices/downhole tools. The devices may include a drone configured to perform one or more functions downhole. According to an aspect, a wellhead launcher is utilized for inserting a drone into a wellbore. The wellhead launcher includes a hollow casing enclosing a drone compartment. The drone compartment is configured to receive the drone and has an entrance and an exit. The exit of the drone compartment is connected to the wellbore. A drone launch mechanism is disposed inside the wellhead receiver hollow casing adjacent the drone compartment and is configured to exert a launch force on the drone thereby pushing the drone out of the drone compartment and toward the wellbore.

Further embodiments of the disclosure are associated with a wellhead receiver for conveying a drone into a wellbore. The wellhead launcher includes a hollow casing enclosing a drone compartment. According to an aspect, the drone compartment is configured to receive the drone and has an entrance and an exit. The wellhead receiver includes an entry valve adjacent the drone compartment entrance, and the entry valve is configured to permit entry of the drone through the entrance into the drone compartment and to permit the drone compartment to be sealed after entry of the drone. A launcher valve is disposed between the drone compartment exit and the wellbore, which is typically subject to a set of wellbore conditions. The launcher valve may be configured to selectively seal and expose the drone compartment from the set of wellbore conditions. Additionally, the launcher valve may be configured to permit the drone to depart the drone compartment and enter the wellbore.

Further embodiments of the disclosure may be associated with a method for delivering a drone into a wellbore. The method utilizes a wellhead receiver and includes preparing the drone compartment to receive the drone. According to an aspect, the drone compartment is enclosed by a hollow casing of the wellhead receiver and the drone is conveyed to an entrance of the drone compartment and inserted through the drone compartment entrance into the drone compartment. An entry valve connected to the wellhead receiver adjacent the drone compartment entrance is closed to seal the drone compartment entrance and a set of drone compartment conditions in the drone compartment is adjusted to approximate a set of wellbore conditions existing in the wellbore. A launcher valve connected to the wellhead receiver disposed between a drone compartment exit and the wellbore is opened to permit the drone to depart the drone compartment and enter the wellbore.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
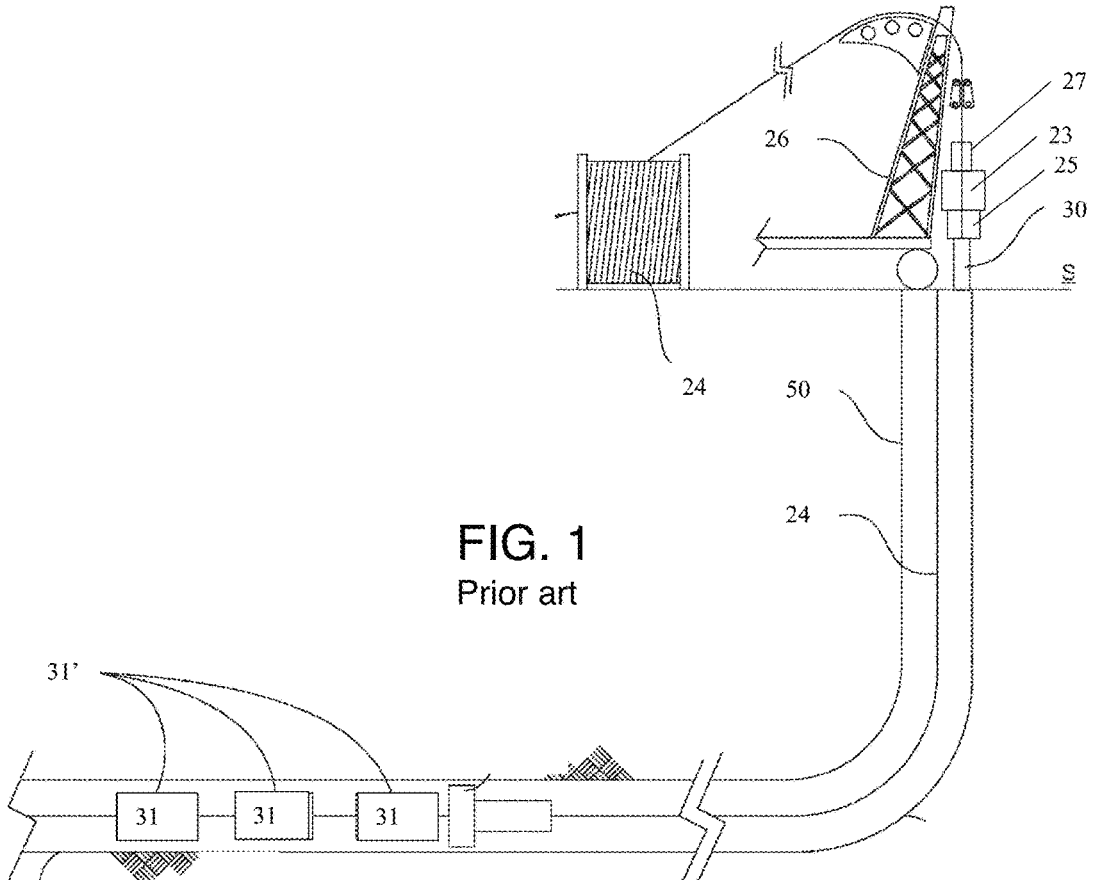
FIG. 1 Prior art
FIG. 1 is a side view of a prior art system for disposing downhole tools in a wellbore by wireline.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of illustrating features of the embodiments, embodiments of the disclosure will now be introduced in reference to the figures. Those skilled in the art will recognize that this example is illustrative and not limiting and is provided purely for explanatory purposes.

This application incorporates by reference each of the following pending patent applications in their entireties: U.S. Provisional Patent Application No. 62/842,329, filed May 2, 2019; U.S. Provisional Patent Application No. 62/841,382, filed May 1, 2019; International Patent Application No. PCT/IB2019/000526, filed Apr. 12, 2019; U.S. Provisional Patent Application No. 62/831,215, filed Apr. 9, 2019; International Patent Application No. PCT/IB2019/000530, filed Mar. 29, 2019; U.S. Provisional Patent Application No. 62/832,737, filed Mar. 26, 2019; International Patent Application No. PCT/IB2019/000537, filed Mar. 18, 2019; U.S. Provisional Patent Application No. 62/816,649, filed Mar. 11, 2019; U.S. Provisional Patent Application No. 62/720,638, filed Aug. 21, 2018; U.S. Provisional Patent Application No. 62/765,185, filed Aug. 16, 2016; U.S. Provisional Patent Application No. 62/719,816, filed Aug. 20, 2018; U.S. Provisional Patent Application No. 62/690,314, filed Jun. 26, 2018; U.S. Provisional Patent Application No. 62/678,654, filed May 31, 2018; and U.S. Provisional Patent Application No. 62/678,636, filed May 31, 2018.

In general, the embodiments of the disclosure concern the use of one or more drones in drilling and, especially, well completion operations. As used herein, the term "drone" refers to a downhole tool or toolstring not connected to a physical wire/cable, i.e., the term "drone" refers generally to an untethered downhole tool. Drones are configured for deployment into and use in a wellbore. The drone may be configured to move at pump speed or flow rate speed (i.e., the speed at which fluid is pumped into the wellbore).

Figure 2:
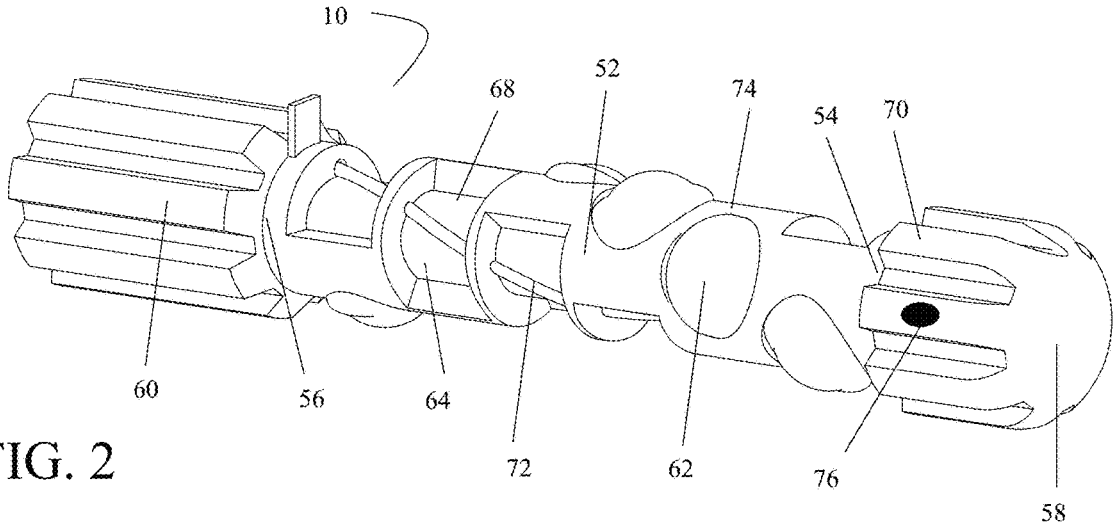
FIG. 2 is a perspective view of a drone specifically configured as a perforating gun for deployment via a drone conveyance system, according to an embodiment.

With reference to FIG. 2, an exemplary embodiment of a drone 10 is shown. As described herein, the drone 10 may include a wellbore tool and may be launched autonomously or semi-autonomously into the wellbore 50. The wellbore tools may include, for example and without limitation, a perforating gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. The wellbore tool drones 10 are deployed in the wellbore 50, without requiring a wireline assembly.

The exemplary drone 10 shown in FIG. 2 is in the configuration of a downhole tool often referred to as a perforating gun. This perforating gun drone includes a body portion 52 having a front end 54 and a rear end 56. A head portion 58 extends from the front end 54 of the body portion 52 and a tail portion 60 extends from the rear end 56 of the body portion 52 in a direction opposite the head portion 58. The body portion 52 includes a plurality of shaped charge apertures 74 and open apertures 64. Each of the plurality of shaped charge apertures 74 are configured for receiving and retaining a shaped charge 62.

In the exemplary perforating gun drone embodiment, the body portion 52 is a unitary structure that may be formed from an injection-molded material, as are the head portion 58 and the tail portion 60. In other embodiments, the body portion 52, the head portion 58 and the tail portion 60 may constitute modular components or connections. As shown in FIG. 2, each of the body portion 52, the head portion 58 and the tail portion 60 is substantially cylindrically-shaped and may include fins 70. Each of these features is configured with regard to its travel as a drone 10 into the wellbore 50.

Figure 3:
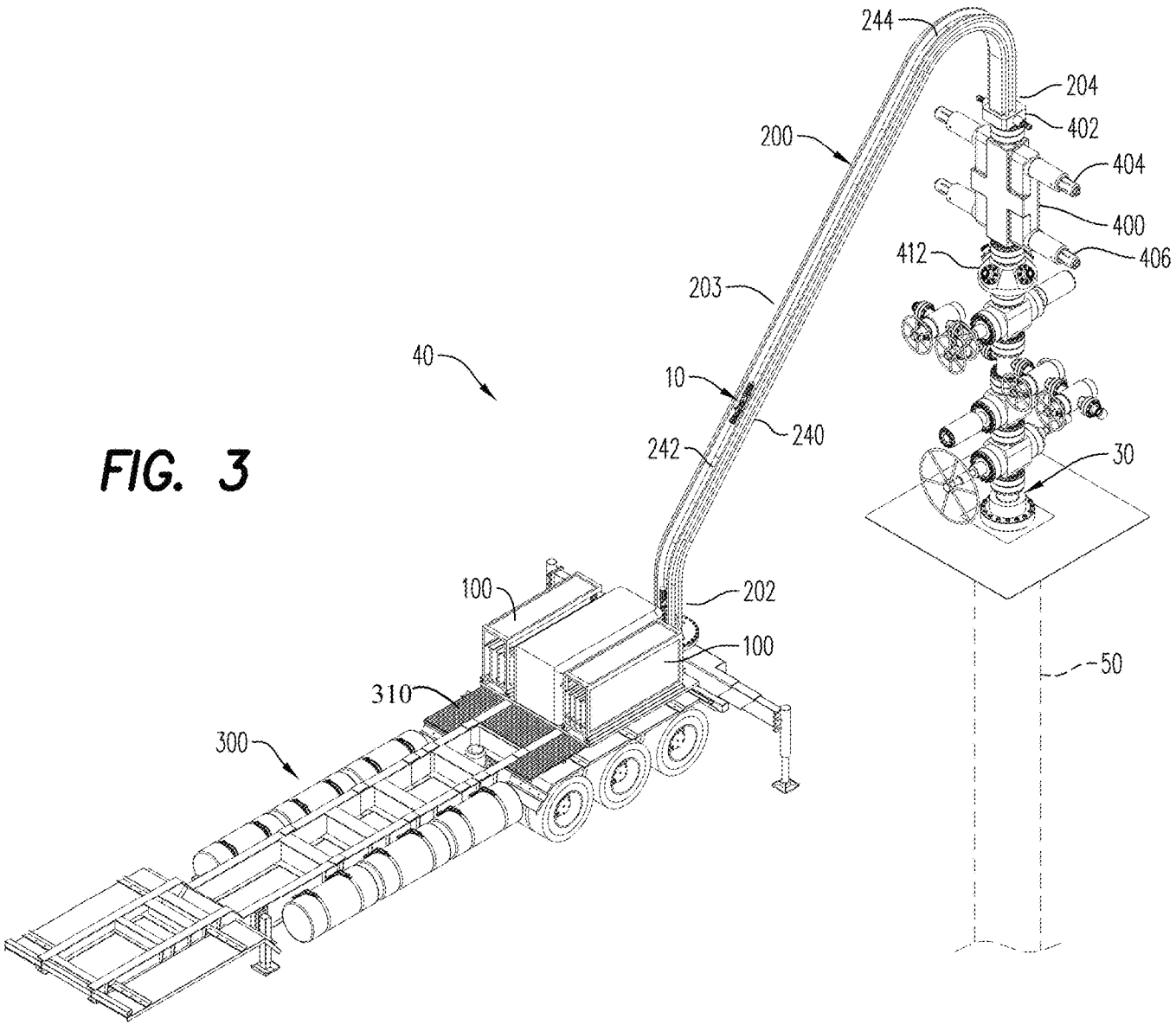
FIG. 3 is a perspective view of a drone conveyance system, according to an embodiment.

Turning now to FIG. 3, an embodiment of a drone conveyance system 40 is illustrated. The function of drone conveyance system 40 is to select a drone 10 and then convey the selected drone 10 into a wellbore 50. The drone conveyance system 40 may include one or more drone magazines 100 and a drone conveyance 200. Each drone magazine 100 is designed to be loaded with a plurality of drones 10 and multiple drone magazines 100 may be utilized. The drone conveyance 200 has a conveyance entrance 202, a conveyance exit 204 and a conveyance portion 203 between the conveyance entrance 202 and conveyance exit 204 configured to convey the drone 10 between the entrance 202 and exit 204. The conveyance entrance 202 is located proximate the drone magazine 100 and receives a selected drone 10 from the drone magazine 100. The conveyance exit 204 is connected to a wellhead 30, by way of a wellhead launcher 400. The various structures between the conveyance exit 204 and wellhead 30 will orientate the drone 10 and otherwise prepare the drone 10 for deposit into the wellbore 50.

According to an aspect, the drone magazines 100 are disposed on a platform 300. In the embodiment illustrated in FIG. 3, the platform 300 is in the form of a truck trailer. Generally, the platform 300 may be fixed or mobile and performs the primary function of providing a stable place to put the drone magazines 100 adjacent the conveyance entrance 202. A platform receiver 310 may also be supported by platform 300. The platform receiver 310 may be connected to the conveyance entrance 202 and configured to receive the drone 10 from the drone magazine 100 and prepare the drone 10 for deposit into the conveyance entrance 202.

Figure 4:
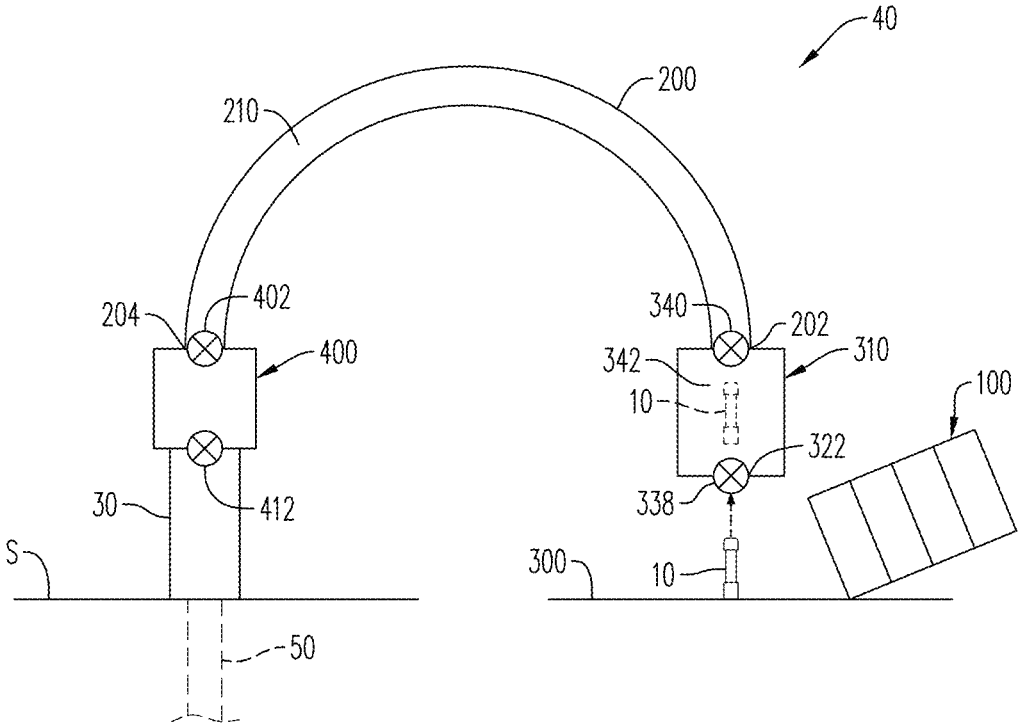
FIG. 4 is a side view of a drone conveyance system, according to an embodiment.

In an embodiment, and as illustrated in FIG. 4, a platform receiver 310 is disposed above a platform 300. The platform receiver 310 may be provided with a chamber opening 322 on the underside thereof. The chamber opening 322 is sized to permit the insertion of a drone 10 into a receiving chamber 342 located inside the platform receiver 310. A magazine 100, supported by the platform 300, may be connected to or positioned adjacent the chamber opening 322. In the event that a magazine 100 is used, a mechanism associated with either the magazine 100 or the platform 300 will move a drone 10 from the magazine 100, through the chamber opening 322 into the receiving chamber 342. If a magazine is not used, a mechanism associated with the platform 300 moves the drone 10 into the receiving chamber 342 or the drone 10 is manually moved into the receiving chamber 342. The mechanism that moves the drone 10 into the receiving chamber may be an actuator, lift, or similar device. If necessary, a platform receiver valve 338 can close the chamber opening 322 so that the receiving chamber 342 and the drone 10 may be subjected to the conditions of an elongate chamber 210 of the conveyance 200. Once the drone 10 is subjected to the conditions of the elongate chamber 210, an elongate chamber valve 340 configured to seal the receiving chamber 342 from the elongate chamber 210, may be opened and the drone 10 moved through the conveyance entrance 202 into the elongate chamber 210. According to an aspect, the elongate chamber 210 may include chamber fluid, to help move the drone 10 received from the platform receiver 310 to a drone conveyance system/wellhead launcher/wellhead receiver 400. The chamber fluid may include pressurized gas, a liquid or any other mechanism that can reduce potential friction of the drone 10 while moving in the elongate chamber 210.

As further illustrated in FIG. 4, a wellhead receiver 400 may be connected to the conveyance exit 204 end of the conveyance 200, adjacent the wellhead 30. The wellhead receiver 400 may also be connected to the wellhead 30. The wellhead 30 usually extends from the surface S of the ground into which the wellbore 50 is formed. The wellhead receiver 400 receives the drone 10 from conveyance exit 204 and prepares the drone 10 for deposit into the wellbore 50 through the wellhead 30. Deposit of the drone 10 into the wellbore 50 may also be referred to as dropping the drone 10 into the wellbore 50. The wellhead receiver 400 receives the drone 10 at whatever the conditions are of the elongate chamber 210.

Figure 5:
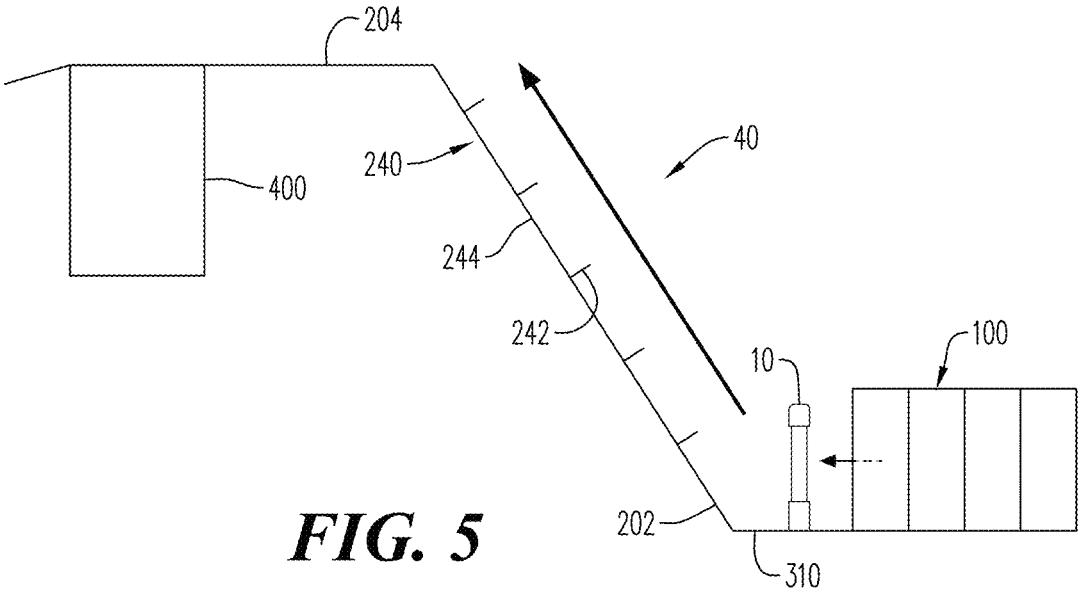
FIG. 5 is a side view of a drone conveyance system, according to an embodiment.

FIG. 5 illustrates an alternate embodiment of a drone conveyance system 40. The drone conveyance system 40 may include a platform receiver 310 having a structure that is simple to manufacture and use. According to an aspect, the drone conveyance system includes a ramp 240, a conveyer 244 and a plurality of sleds 242 attached to the conveyer 244. By way of example, the conveyer 244 may be a conveyer belt or a conveyer chain, either one of which may be formed in a continuous loop. The sleds 242 may be attached to the conveyer 244 and carried on the continuous loop. The sleds 242 serve the function of engaging a drone 10 at the conveyance entrance 202 and conveying the drone 10 to the conveyance exit 204, where it may be deposited in the wellhead launcher 400. The magazine 100 may be designed to present a drone 10 for engagement by a conveyor sled 242. Alternatively, an intervening element may convey a drone 10 from the magazine 100 to a position where it may be engaged by a conveyor sled 242.

Figure 6:
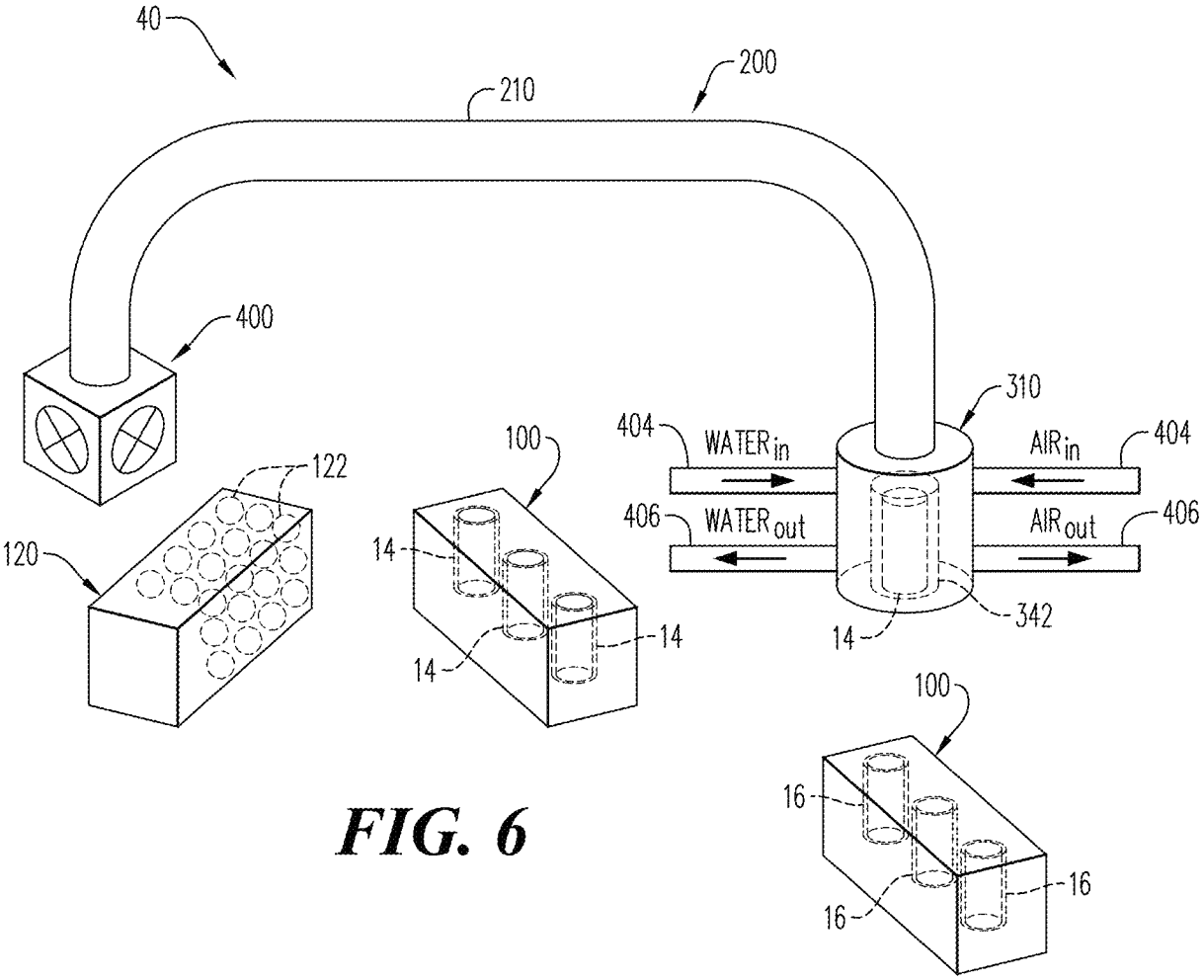
FIG. 6 is a perspective view of a drone conveyance system, according to an embodiment.

FIG. 6 illustrates a generalized drone conveyance system 40 that includes a platform receiver 310, an elongate conveyance chamber 210 (described hereinabove) and a wellhead launcher 400. Each of two otherwise identical magazines 100 shown in FIG. 6 contains drones 14 or 16 configured as distinct wellbore tools. For example, drone 16 may be configured as a frac plug 16 and drone 14 may be configured as a perforating gun 14. Switching between the two magazines 100 allows for selectively ordering of the wellbore tool being deposited into the wellbore 30 between the frac plug 16 tool and the perforating gun 14 tool.

An alternative magazine shown in FIG. 6 is a drop ball/frac ball magazine 120 holding a plurality of drop balls/frac balls 122. The frac ball magazine 120 may be connected to the platform receiver 300. When it is desired to dispose the frac ball 122 in the wellbore 50, the frac ball 122 is inserted in the receiving chamber 342 of the platform receiver 310 and conveyed to the wellhead launcher 400 by the conveyance 200. Alternatively, the frac ball magazine 120 may be attached directly to the wellhead receiver 400. The frac balls 122 may serve a variety of purposes. For example, the frac plug 16 may be activated by the frac ball 122. The frac ball 122 disposed in the wellbore 50 will travel down to the frac plug 16 and engage an opening that was allowing fluid flow through the frac plug 16. Once the frac ball 122 engages the opening, fluid will no longer flow through the frac plug 16 and the wellbore pressure can be increased by pumping fluid.

Whether the drone 10 is conveyed from the conveyance entrance 202 to the conveyance exit 204 by the drone conveyance system or merely inserted manually into the wellhead launcher 400, the drone 10 will typically need to be prepared for deposit into the wellbore 50. FIGS. 7-10 illustrate embodiments of the wellhead launcher 400 for use in receiving and preparing the drone 10 for insertion into the wellbore 50 through the wellhead 30.

Figure 7:
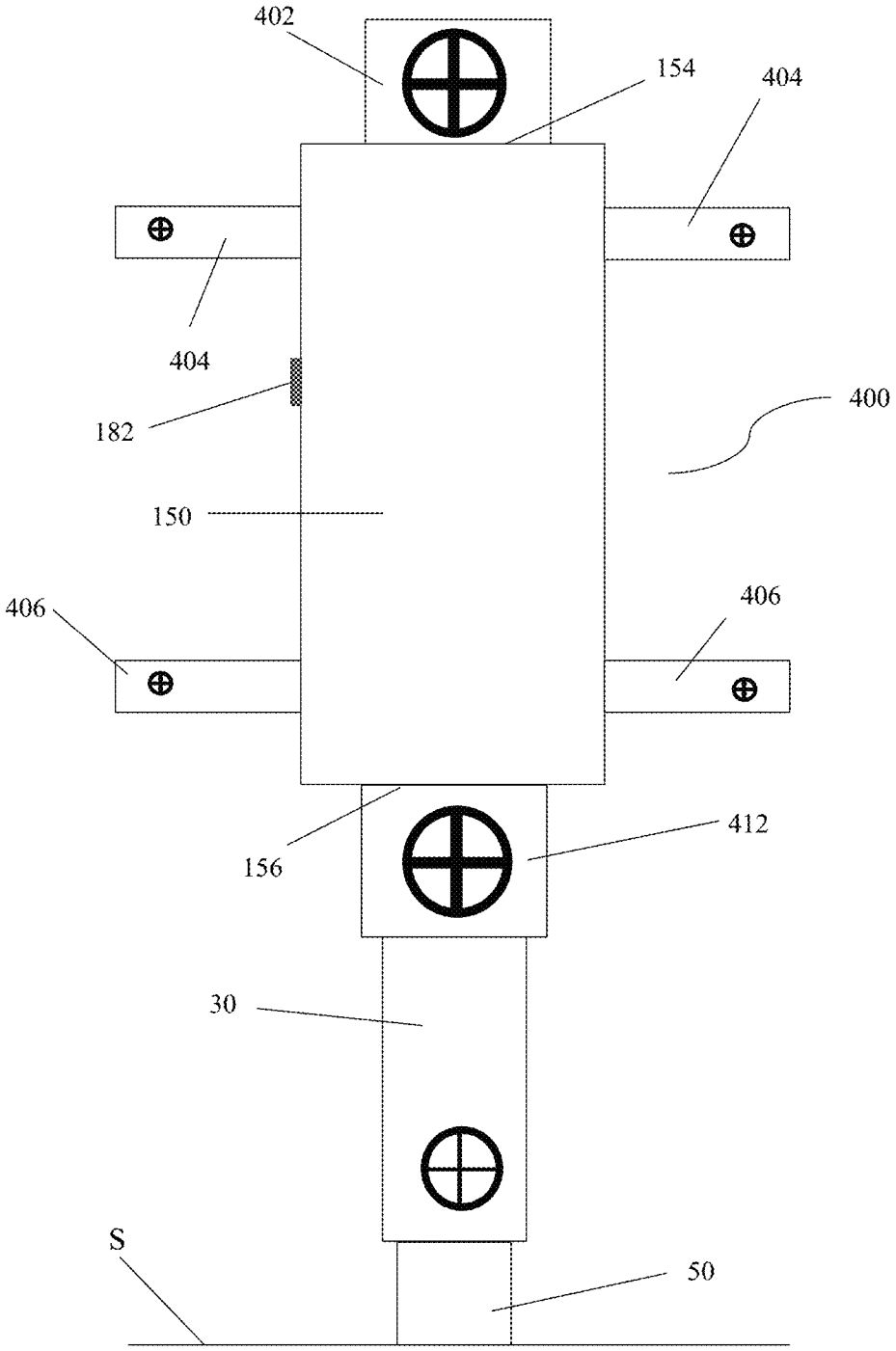
FIG. 7 is a side view of a wellhead receiver of the drone conveyance system shown in any one of FIGS. 3, 4, 5 and 6 according to an embodiment.
Figure 8:
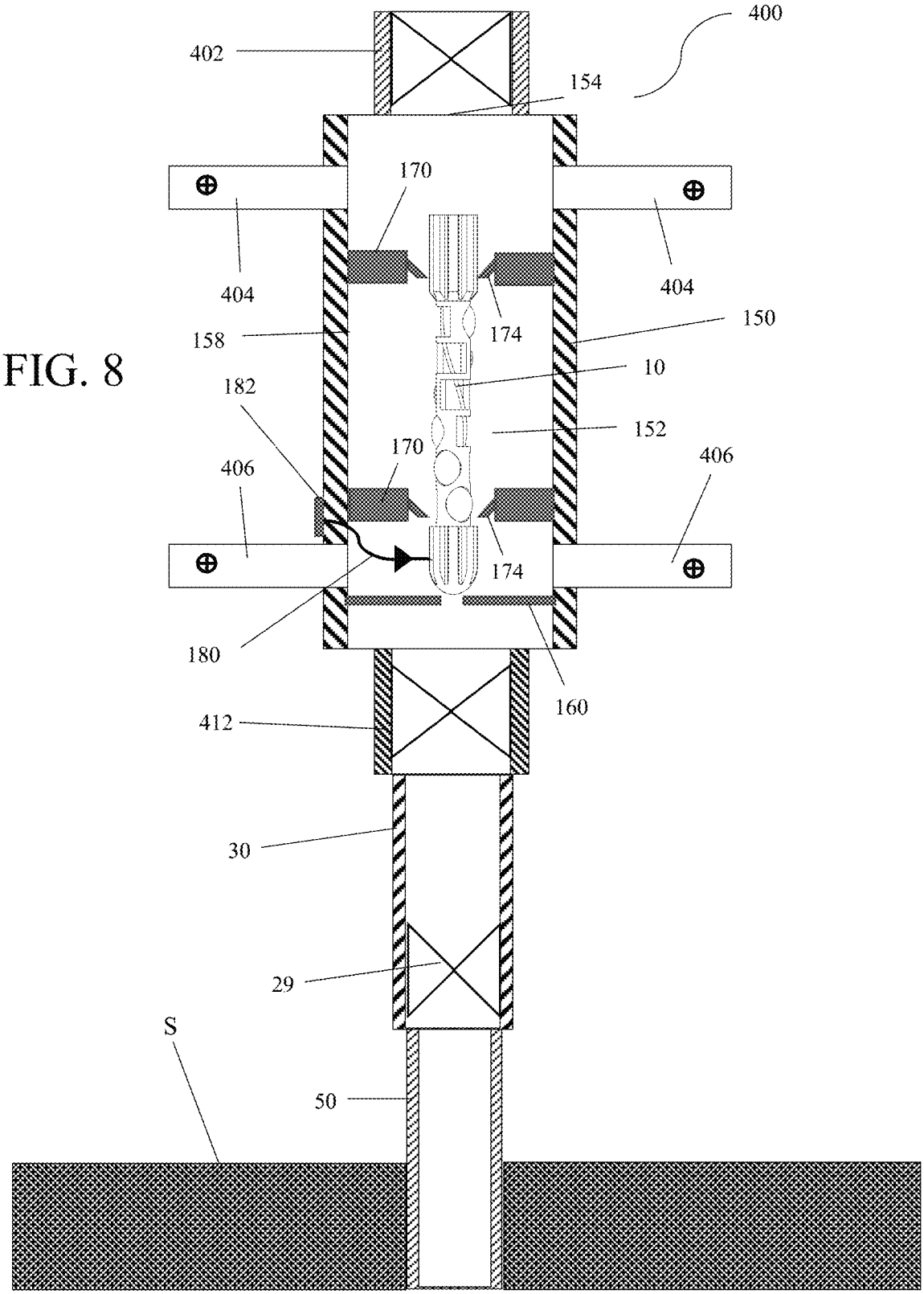
FIG. 8 is a cross-sectional view of the wellhead receiver shown in FIG. 7, illustrating a drone in position to be inserted into the wellbore through the wellhead, according to an embodiment.

FIG. 7 generally illustrates the components of the wellhead launcher 400 in accordance with an embodiment. FIG. 8 shows the interior portions of the wellhead launcher 400 of FIG. 7. The drone 10 may be inserted into the drone compartment 152, i.e., the hollow interior of casing 150, of the wellhead launcher 400 through a wellhead launcher valve 402. In the event that a drone conveyance system 40 is utilized, the wellhead launcher valve 402 is disposed between the drone conveyance exit 204 and the hollow casing 150 of the wellhead launcher 400. In an open position, the wellhead launcher valve 402 allows insertion of the drone 10 into the hollow casing 150. Once the drone 10 is present in the wellhead launcher 400, the wellhead launcher valve 402 may be closed so as to seal the wellhead launcher 400 from the conditions in the drone conveyance system 40. The conditions of the drone conveyance system 40 may be atmospheric, e.g., for the ramp 240 and sled 242 system shown in FIG. 5, or may be the conditions in the elongate chamber 210 for the system shown in FIG. 4.

Once the drone 10 is present in the drone compartment 152 of the wellhead launcher 400 and the wellhead launcher valve 402 is closed, the conditions in the drone compartment 152 are adjusted to the conditions in the wellbore 50, since the conditions in the wellbore 50 may be very different from the conditions elsewhere, e.g., atmospheric or in the elongate chamber 210. Adjustment of the conditions in the drone compartment may be performed utilizing one or more lubrication inlets 404 and lubrication outlets 406. Although referred to generally as 'lubrication' inlets and outlets, a number of different fluids, e.g., water and air, may be inserted into and removed from the wellhead launcher 400 utilizing these inlets/outlets 404, 406. In addition, each inlet and outlet may be a valve that can be opened or closed and through which fluid flows based on a pressure differential across the valve.

A launcher valve 412 is located between the drone compartment 152 of the wellhead launcher 400 and the wellhead 30. The launcher valve 412, when closed, seals the wellhead launcher 400 off from the conditions of the wellbore 50. The launcher valve 412 may typically be in its closed position whenever the wellhead receiver valve 402 is open, e.g., when inserting a drone 10 into the drone compartment 152. With the drone 10 positioned in the drone compartment 152 and both the wellhead receiver valve 402 and the launcher valve 412 are closed, the lubricators 404, 406 are operated to expose the drone 10 inside the drone compartment 152 to approximately the conditions of the wellbore 50. Once the conditions in the drone compartment 152 are approximately those of the wellbore 50, the launcher valve 412 may be opened and the drone 10 dropped or pushed through the launcher valve 412 and wellhead 30 into the wellbore 50.

In an embodiment, alternative or supplemental to the launcher valve 412, a drone gate 160 may be used to support the drone 10 when it is in the drone compartment 152. The drone gate 160 may be operated to release the drone 10 from the drone compartment when it is desired to insert the drone 10 into the wellbore 50. In the event that the launcher valve 412 is eliminated due to the presence of the drone gate 160, a valve 29 in the wellhead 30 may perform the function of sealing the wellbore 50 off from the drone compartment 152 when necessary.

Depending upon a number of factors, other structures in addition to the drone gate 160 may be provided in the drone compartment to support the drone 10 when, for example, it is being prepared for insertion into the wellbore 50. Such factors include turbulent conditions that may be present in the drone compartment 152 during various points between the drone 10 being placed in the drone compartment and insertion of the drone into the wellbore 50. As illustrated in FIG. 8, for example, drone clamps 170 may extend from the inner wall 158 of the hollow casing 150 of the wellhead launcher 400. These drone clamps 170 may be in the form of annular ring or a plurality of blocks sized to accommodate the drone 10, align it in an appropriate orientation and limit, at least to some degree, its radial movement inside the drone compartment. Further, in an embodiment, the drone clamps 170 may have clamp wings 174 that extend toward the drone 10 and further aid in stabilizing the drone 10. For example, the clamp wings 174 may prevent the drone from axial movement in the drone compartment 152 caused by turbulence.

Figure 11:
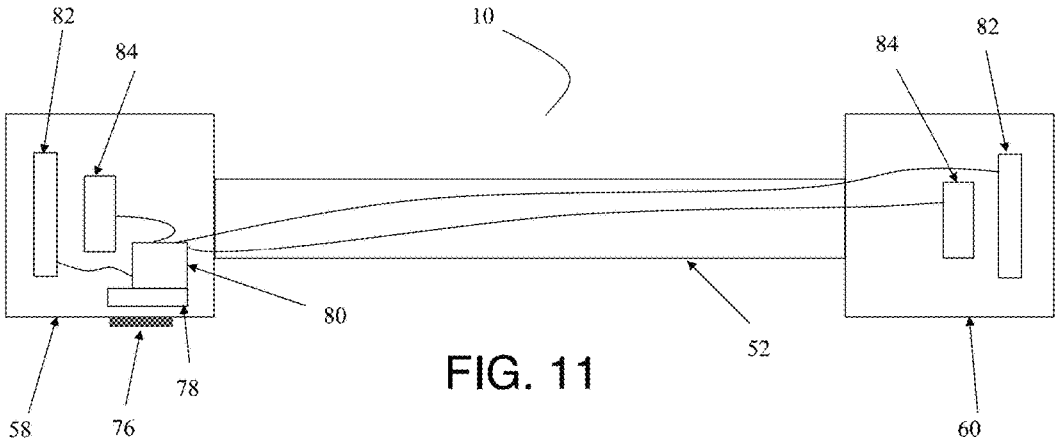
FIG. 11 is a cross-sectional view of a drone according to an embodiment.

Proper positioning of the drone 10 in the drone compartment 152 may also assist with allowing access by an electrical connection 180 in the drone compartment 152 to a connection point 76 on the drone 10. The connection between the connection point 76 on the drone 10 and the electrical connection 180 in the drone compartment 152 may be mechanical, electrical, magnetic, electromagnetic, or the like. FIG. 11 illustrates a general layout of electronics in the drone 10. In an embodiment, the connection point 76 is located on the head 58 of the drone 10. In the event that the drone 10 contains a power supply 78 and/or an onboard computer 80, the electrical connection 180 may provide either or both power charging and instructions to the drone 10 through the connection point 76. Further, the electronics of the drone 10 may be interrogated through the electrical connection 180 to assess its identity and current status, e.g., current instructions. The drone 10 may include one or more navigational sensors 82 as well as other electronic sensors 84 electrically connected to the computer 80 and power supply 78. U.S. application Ser. No. 16/537,720, filed Aug. 12, 2019 (published as US2020/00063553 on Feb. 27, 2020), incorporated herein by reference in its entirety, describes a drone navigation system suitable for use with the drone 10 described herein.

In an embodiment, interrogation of the drone 10 may include pre-deployment testing to confirm that the drone 10 satisfies a given set of parameters. The parameters may be set to confirm that the drone 10 will operate as desired in the wellbore 50. The parameters may also be set to confirm that the drone selected is of the correct configuration sought to be next dropped into the wellbore 50. In the event of negative results for the tested parameters, the drone 10 may be removed from the wellhead launcher 400. Alternatively, the drone 10 may be reprogrammed through electrical connection 180. More generally, drone programming, i.e., providing instructions to electronics inside the drone 10, may be accomplished simultaneously with pre-deployment testing. The details of the programming provided to a particular drone 10 will depend upon the type of drone it is and the details of the job being performed.

Electrical power typically supplied via the wireline cable 24 to wellbore tools 31 such as a tethered drone or conventional perforating gun, as shown in FIG. 1, would not be available to a drone 10. In an embodiment and as shown in FIG. 11, components of the drone 10 may be supplied with electrical power by the power supply 78. The power supply 78 may occupy any portion of the drone 10, i.e., one or more of the body 52, head 58 or tail 60. It is contemplated that the power supply 78 may be disposed so that it is adjacent components of the drone 10 that require electrical power.

An on-board power supply 78 for a drone 10 may take the form of an electrical battery; the battery may be a primary battery or a rechargeable battery. Whether the power supply 78 is a primary or rechargeable battery, it may be inserted into the drone at any point during construction of the drone 10 or immediately prior to insertion of drone 10 into the wellbore 50. If a rechargeable battery is used, it may be beneficial to charge the battery immediately prior to insertion of the drone 10 into the wellbore 50. Charge times for rechargeable batteries are typically on the order of minutes to hours.

In an embodiment, another option for power supply 78 is the use of a capacitor or a supercapacitor. A capacitor is an electrical component that consists of a pair of conductors separated by a dielectric. When an electric potential is placed across the plates of the capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When the capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage outlet by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, an on-board power supply 78 for a drone 10 may take the form of a capacitor or a supercapacitor, particularly for rapid charge and discharge capabilities. A capacitor may also be used to provide additional flexibility regarding when the power supply is inserted into the drone 10. This flexibility stems from the fact that the capacitor will not provide power until it is charged. Thus, shipping and handling of a drone 10 containing shaped charges 62 or other explosive materials presents low risks where an uncharged capacitor is installed as the power supply 78. Further, and as discussed previously, the act of charging a capacitor is very fast. Thus, the capacitor or supercapacitor being used as a power supply 78 for drone 10 can be charged immediately prior to deployment of the drone 10 into the wellbore 50.

A drone 10 may be shipped when preloaded with a rechargeable battery which has not been charged, i.e., the electrochemical potential of the rechargeable battery is zero. If this option is utilized, it may be desirable to ensure that no electrical charge is capable of inadvertently accessing any and all explosive materials in the drone 10.

In an embodiment, electrical components like the computer/processor 80, the navigational sensors 82 and the other electronic components 84 may be battery powered while explosive elements like a detonator for initiating detonation of the shaped charges 62 are capacitor powered. Such an arrangement would take advantage of the possibility that some or all of the computer/processor 80, the navigational sensors 82 and the other electronic components 84 may benefit from a high density power supply having higher energy density, i.e., a battery, while initiating elements such as detonators typically benefit from a higher power density, i.e., capacitor/supercapacitor. A benefit for such an arrangement is that the battery is completely separate from the explosive materials, affording the potential to ship the drone 10 preloaded with a charged or uncharged battery. The power supply that is connected to the explosive materials, i.e., the capacitor/supercapacitor, may be very quickly charged immediately prior to dropping drone 10 into wellbore 50, e.g., by electrical connection 180 when drone 10 is present in the drone compartment 152 of the wellhead launcher 400.

Figure 9:
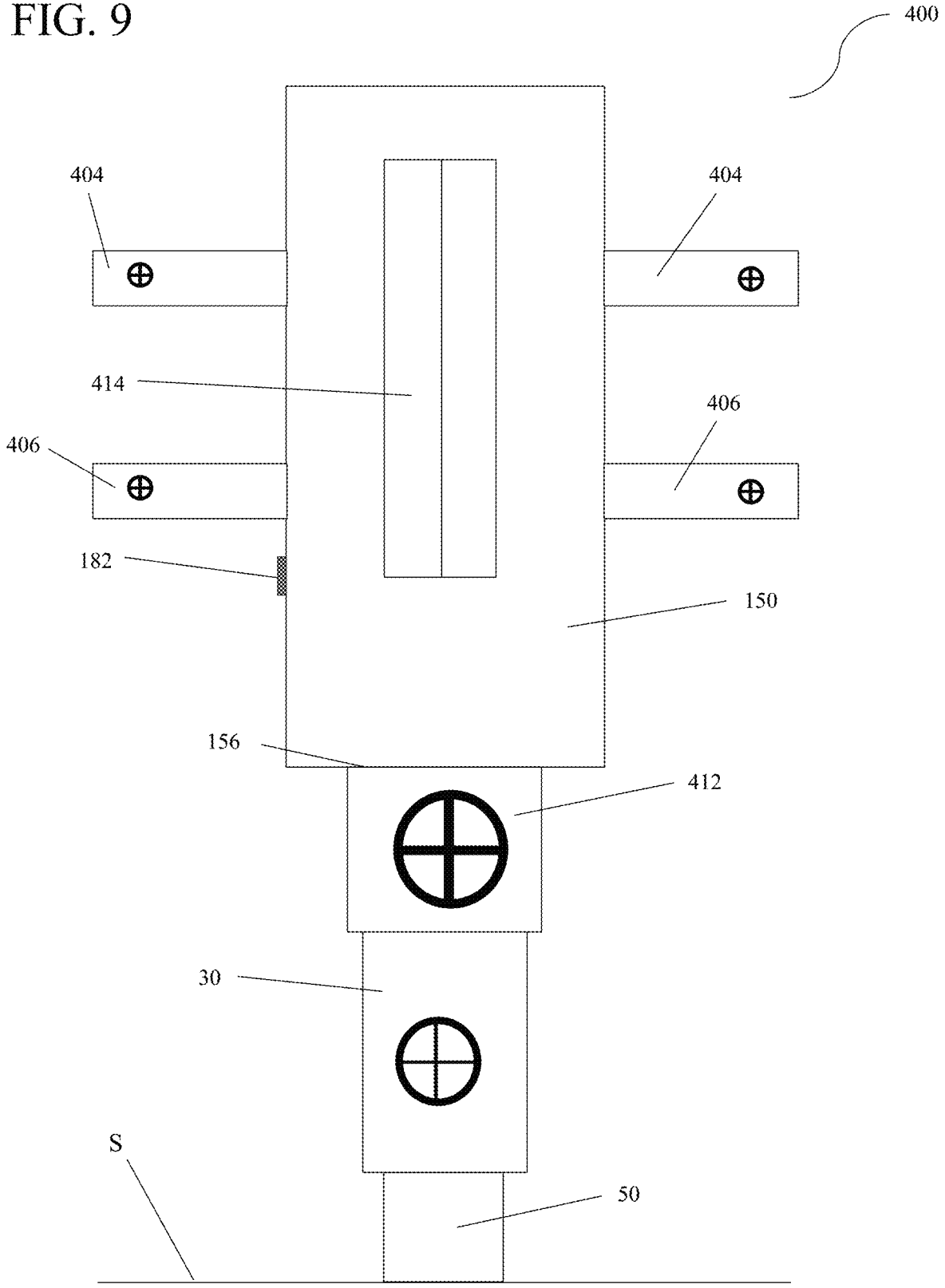
FIG. 9 is a side view of a wellhead receiver, according to an embodiment.
Figure 10:
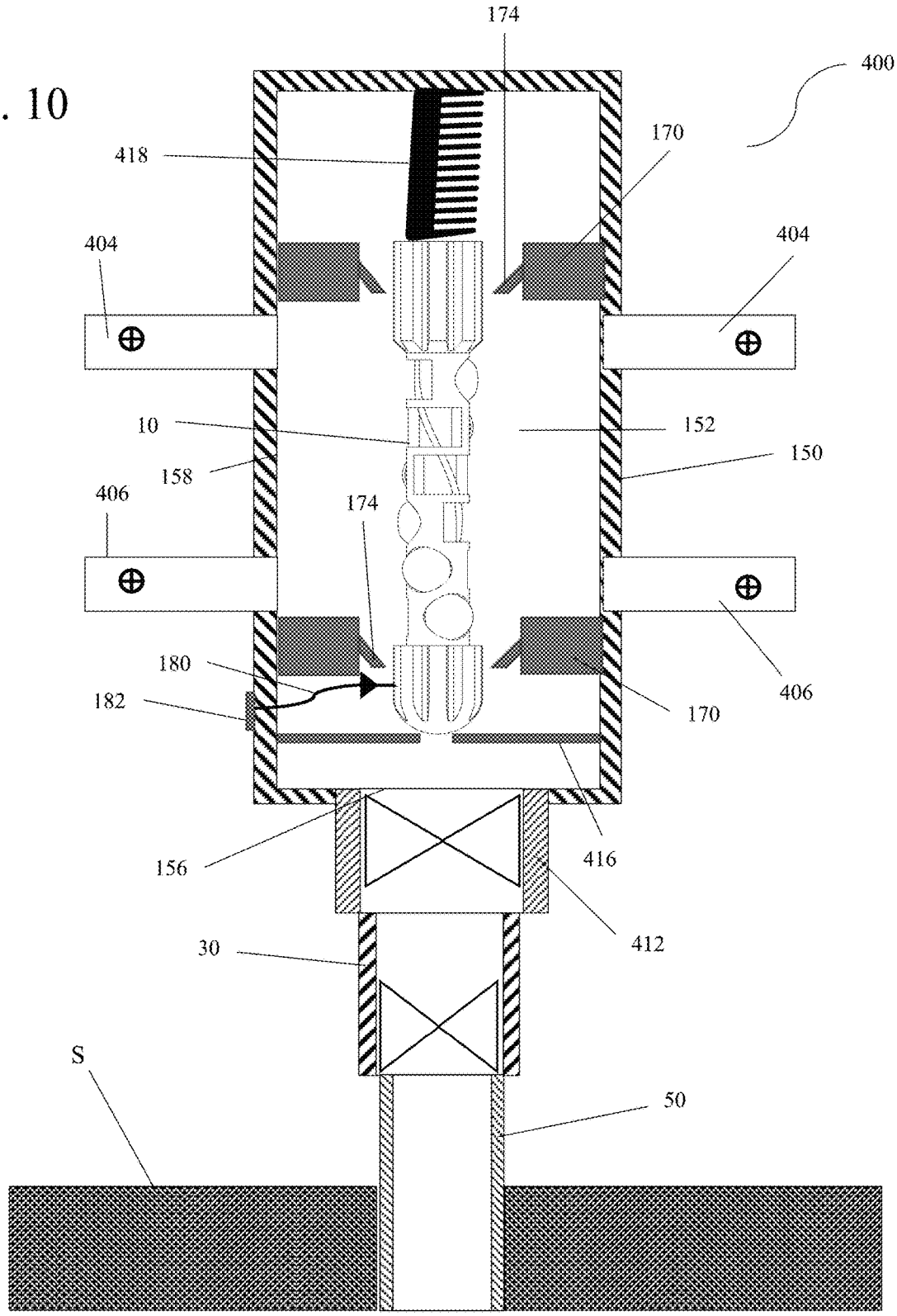
FIG. 10 is a cross-sectional view of the wellhead receiver shown in FIG. 9 containing a drone in position to be inserted into the wellbore through the wellhead, according to an embodiment.

FIGS. 9 and 10 illustrate an embodiment that does not connect the conveyance entrance 202 of the drone conveyance system 40 to the top of the wellhead launcher 400. Rather, the drone 10 may be inserted into the drone compartment 152 of the hollow casing 150 of the wellhead launcher 400 through a drone opening 414. The drone opening 414 may take the form of the doors disclosed in FIG. 9 located on the side of wellhead launcher 400 or an opening at the top or bottom of the wellhead launcher. The form of the drone opening 414 is not of critical importance as long as it is sized to permit loading of the drone 10 into the drone compartment 152. The drone opening 414 may also be able to seal the drone compartment 152 such that the conditions in the drone compartment 152 are adjusted to approximately those of the wellbore 50. Insertion of the drone 10 through drone opening 414 may also simplify attachment of the electrical connection 180 to the drone electrical contact point 182 as well as removal of the drone 10 from the wellhead launcher 400 if necessary, e.g., if the drone 10 does not 'pass' a pre-deployment test. The drone opening 414 may also be provided on embodiments of the wellhead launcher 400 that connect the conveyance entrance 202 of the drone conveyance system 40 to the wellhead launcher 400 for electrical attachment and drone removal purposes.

According to an aspect, where conditions in the drone compartment 152 are adjusted to approximate those of the wellbore 50, it may not be possible to simply 'drop' the drone 10 through the wellhead 30 and into the wellbore 50. One means of assisting insertion of the drone 10 into the wellbore 50 is the use of fluid inputs 404 to 'pump' fluid into the wellbore 50, which may result in the drone 10 being carried along with the fluids being pumped into the wellbore 50. Another way to assist insertion of the drone 10 into the wellbore 50 is an ejection unit 418 (FIG. 10) associated with the wellhead launcher 400, e.g., on the inner wall surface 158 of the wellbore receiver hollow casing 150, adjacent some portion of the drone 10. The ejection unit 418 exerts a launch force on the drone 10, accelerating it into the wellbore 50. By way of example, the ejection unit 418 may include a compressed spring that, when released, exerts the desired launch force on the drone 10. Alternatively, the launch force exerted by the ejection unit 418 may take the form of a compressed fluid, gas or liquid, directed at the drone 10 and accelerating it into the wellbore 50—a small explosive charge may operate in a very similar way. Once past the wellhead 30 and resident in the wellbore 50, the drone 10 will be subject to the force of gravity as well as the flow of fluid through the wellbore 50. Thus, exertion of force other than by the ejection unit 418 is typically unnecessary.

Although the ejection unit 418 is only illustrated in FIG. 10, it is contemplated that the ejection unit 418 may be included as part of any wellhead launcher 400 embodiment presented herein.

Figure 12A:
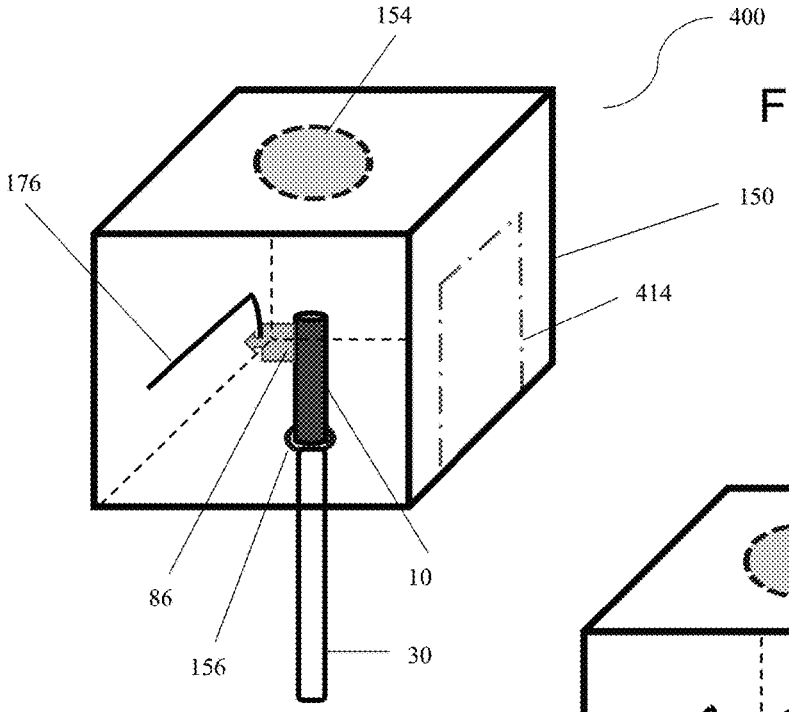
FIG. 12A is a cutaway view of a wellhead receiver, according to an embodiment.
Figure 12B:
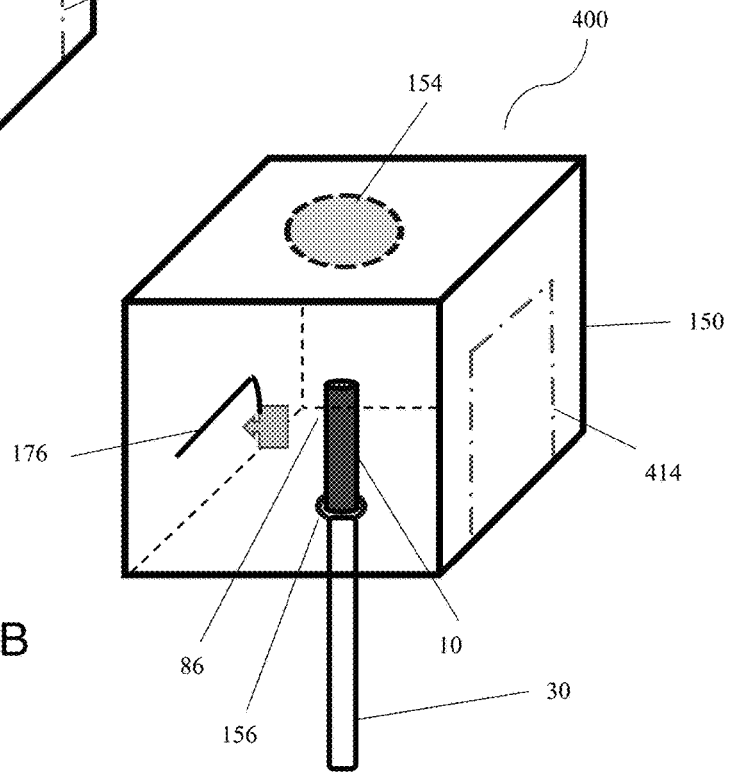
FIG. 12B is a cutaway view of the wellhead receiver of FIG. 12A.

Downhole tools 31 often have activation pins or latches that prevent certain functions from occurring prior to the tool being through the wellhead 30 into the wellbore. For example, in the event that the drone 10 contains explosives or pyrotechnics, it is very important to prevent initiation of these elements prior to dropping the drone 10 into the wellbore. As seen in FIGS. 12A and 12B, a safety device 86 may be included with each drone 10 that prevents some or all functions of the drone 10. Removal or deactivation of the safety device 86 is achieved by a safety device actuator 176 prior to inserting the drone 10 through the wellhead 30 and into the wellbore. Locating the safety device actuator 176 inside the wellhead launcher 400 may provide the highest level of safety, since it is the last possible opportunity for actuating the safety device 86. The drone enters the wellhead launcher 400 through the drone compartment entrance 154 and exits, after safety device 86 is removed, through the drone compartment exit 156. Drone insertion opening 414 may be used to access the drone 10 when present in the wellhead launcher 400 and/or for removal of the drone 10 from the wellhead launcher 400.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a"

(or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A wellhead launcher for inserting a drone into a wellbore, the wellhead launcher comprising:

a hollow casing enclosing a drone compartment, wherein the drone compartment comprises an entrance configured to receive the drone and an exit connected to the wellbore;

one or more drone clamps attached to an inner wall surface of the hollow casing, wherein the drone clamps are adapted to align the drone in the drone compartment;

a drone launch mechanism disposed inside the hollow casing adjacent the drone compartment, wherein the drone launch mechanism is configured to exert a launch force on the drone and push the drone out of the drone compartment and toward the wellbore; and an electrical connection extending from the inner wall surface of the hollow casing, wherein the electrical connection is configured to electrically contact an electrical contact point of the drone.

2. The wellhead launcher of claim 1, further comprising:

an entry valve adjacent the drone compartment entrance; and a launcher valve disposed between the drone compartment exit and the wellbore, wherein the entry valve is configured to permit entry of the drone through the entrance into the drone compartment and to permit the drone compartment to be sealed after entry of the drone, the wellbore is subject to a set of wellbore conditions and the launcher valve is configured to selectively seal and expose the drone compartment from the set of wellbore conditions, and the launcher valve is configured to permit the drone to depart the drone compartment and enter the wellbore.

3. The wellhead launcher of claim 2, wherein a drone conveyance is attached to the entry valve, wherein the drone conveyance is configured to convey the drone to the wellhead launcher.

4. The wellhead launcher of claim 1, further comprising:

a drone release mechanism connected to the inner wall surface of the hollow casing, wherein the drone release mechanism is configured to retain the drone and to release the drone from the drone compartment to enter the wellbore.

5. A wellhead launcher system comprising:

a wellhead receiver for conveying a drone into a wellbore, the wellhead receiver comprising:

a hollow casing enclosing a drone compartment, wherein the drone compartment comprises:

an entrance configured to receive the drone; and an exit;

a drone safety removal element disposed in the hollow casing adjacent the drone compartment, wherein the drone safety removal element is configured to actuate a safety device disposed on the drone;

an entry valve adjacent the drone compartment entrance, wherein the entry valve is configured to permit entry of the drone through the entrance into the drone compartment and to permit the drone compartment to be sealed after entry of the drone; and a launcher valve disposed adjacent the drone compartment exit; and a wellhead connected to the drone compartment exit and a wellbore casing defining the wellbore, the wellhead being located between the wellhead receiver and the wellbore casing, wherein the wellbore is subject to a set of wellbore conditions and the launcher valve is configured to selectively seal the drone compartment from and expose the drone compartment to the set of wellbore conditions, and the launcher valve is configured to permit the drone to depart the drone compartment and enter the wellbore casing.

6. The wellhead launcher system of claim 5, further comprising:

one or more drone clamps attached to an inner wall surface of the wellhead receiver hollow casing, wherein the drone clamps are adapted to align the drone in the drone compartment and the drone clamps comprise the electrical connection.

7. The wellhead launcher system of claim 5, further comprising:

a fluid inlet and a fluid outlet connected to the wellhead receiver hollow casing configured to alter the conditions in the drone compartment by, respectively, adding and removing fluid from the drone compartment.

8. The wellhead launcher system of claim 5, further comprising:

a drone release mechanism connected to an inner wall surface of the wellhead receiver hollow casing; and a drone launch mechanism disposed inside the wellhead receiver hollow casing adjacent the drone compartment, wherein the drone release mechanism is configured to retain the drone and to release the drone from the drone compartment to enter the wellbore, and the drone launch mechanism is configured to exert a launch force on the drone thereby pushing the drone out of the drone compartment and toward the wellbore.

9. The wellhead launcher system of claim 5, wherein a drone conveyance is attached to the entry valve, the drone conveyance being configured to convey the drone to the wellhead receiver.

10. The wellhead launcher system of claim 5, further comprising:

a drone magazine connected to the entry valve, wherein the drone magazine comprises a magazine frame configured to contain a plurality of drones and to permit movement of the drone from the magazine toward the drone compartment entrance.

11. The wellhead launcher system of claim 10, wherein:

a first group of one or more of the drones is arranged in a first section of the magazine frame;

a second group of one or more of the drones is arranged in a second section of the magazine frame; and the magazine is configured to permit movement of each of the drones from either the first group or the second group, and the magazine is configured to permit alternating movement of each of the drones from the first group or the second group.

12. The wellhead receiver of claim 5, further comprising:

an electrical connection extending from an inner wall surface of the hollow casing, wherein the electrical connection is configured to electrically contact an electrical contact point of the drone.

13. A method for delivery of a drone into a wellbore utilizing a wellhead receiver, the method comprising:

conveying the drone to an entrance of a drone compartment contained in the wellhead receiver;

preparing the drone compartment to receive the drone, the drone compartment being enclosed by a hollow casing of the wellhead receiver;

inserting the drone through the entrance and into the drone compartment;

closing an entry valve connected to the wellhead receiver adjacent the entrance to seal the entrance;

aligning the drone in the drone compartment utilizing one or more drone clamps;

adjusting a set of drone compartment conditions in the drone compartment to approximate a set of wellbore conditions of the wellbore; and opening a launcher valve connected to the wellhead receiver and disposed between a drone compartment exit and the wellbore to permit the drone to depart the drone compartment and enter the wellbore.

14. The drone delivery method of claim 13, further comprising:

moving the drone in the drone compartment, using wing structures that extend from the drone clamps.

15. The drone delivery method of claim 13, wherein the set of wellbore conditions in the wellbore comprise those of a pressurized fluid.

16. The drone delivery method of claim 15, wherein the step of adjusting the set of drone compartment conditions comprises at least one of:

using a fluid inlet connected to the wellhead receiver hollow casing to add the pressurized fluid to the drone compartment; and using a fluid outlet connected to the wellhead receiver hollow casing to remove the pressurized fluid from the drone compartment.

17. The drone delivery method of claim 13, further comprising:

actuating a drone release mechanism connected to the inner wall surface of the wellhead receiver hollow casing; and activating a drone launch mechanism disposed inside the wellhead receiver hollow casing adjacent the drone compartment, wherein the drone launch mechanism exerts a launch force on the drone to push the drone out of the drone compartment and toward the wellbore.

18. The drone delivery method of claim 13, further comprising:

attaching a drone magazine to the entry valve, the drone magazine comprising a magazine frame configured to contain a plurality of drones; and moving the drone from the magazine toward the drone compartment entrance.

19. The drone delivery method of claim 13, further comprising:

removing a safety device connected to the drone utilizing a safety device removal element disposed in the wellhead receiver hollow casing adjacent the drone compartment.

20. The drone delivery method of claim 13, further comprising:

connecting an electrical connection to an electrical contact point of the drone, wherein the electrical connection is located inside the drone compartment and electrically connected to an electrical access point on the outside of the wellhead receiver hollow casing; and performing, with the electrical connection, one or more functions comprising at least one of interrogation of the drone, providing instructions to the drone, and charging a power supply onboard the drone.

* * * * *